United States Patent [19]

Meyer et al.

[11] 4,342,424

[45] Aug. 3, 1982

[54] COMBINED ROTARY IMPULSE SPRINKLER HEAD AND SHUT-OFF VALVE

[75] Inventors: Larry P. Meyer; David C. Dauterman, both of Walla Walla, Wash.

[73] Assignee: Nelson Irrigation Corporation, Walla Walla, Wash.

[21] Appl. No.: 203,627

[22] Filed: Nov. 3, 1980

[51] Int. Cl.[3] ..... B05B 3/08

[52] U.S. Cl. ..... 239/233; 239/263; 239/506

[58] Field of Search ..... 239/230–233, 239/237–242, 262–264, 506, 507, 510–512, 516, 524

[56] References Cited

U.S. PATENT DOCUMENTS

| | | | |
|---|---|---|---|
| 1,710,107 | 4/1929 | Orr . | |
| 1,781,028 | 11/1930 | Mapes . | |
| 1,811,171 | 6/1931 | Buckner . | |
| 2,557,838 | 6/1951 | Phister | 239/506 |
| 2,621,975 | 12/1952 | Coles | 299/125 |
| 2,649,268 | 8/1953 | Stein | 248/83 |
| 3,204,874 | 9/1965 | Senninger | 239/288 |
| 3,402,890 | 9/1968 | Heitzman | 239/66 |
| 3,507,336 | 4/1970 | Nelson | 172/438 |
| 3,559,887 | 2/1971 | Meyer | 239/233 |
| 3,580,507 | 5/1971 | Beamer | 239/233 |
| 3,592,388 | 7/1971 | Friedlander | 239/233 |
| 3,623,666 | 7/1970 | Meyer | 239/230 |
| 3,744,720 | 7/1973 | Meyer | 239/231 |
| 3,986,671 | 10/1976 | Nugent | 239/230 |
| 4,094,467 | 6/1978 | Meyer | 239/230 |
| 4,109,866 | 8/1978 | Brandl | 239/233 |
| 4,153,202 | 5/1979 | Meyer | 239/230 |
| 4,161,286 | 7/1979 | Beamer | 239/230 |
| 4,193,548 | 3/1980 | Meyer | 239/230 |

*Primary Examiner*—Bruce H. Stoner, Jr.
*Assistant Examiner*—Michael J. Forman
*Attorney, Agent, or Firm*—Cushman, Darby & Cushman

[57] ABSTRACT

A sprinkler head assembly rotatable about a generally vertically extending axis, an impulse arm operable in response to the flow of water under pressure for effecting progressive movements of the sprinkler body about said axis, an outwardly facing annular valve seat on the sprinkler body disposed in surrounding relation to the outlet, a poppet valve cooperable with the annular valve seat, a mounting assembly for mounting the poppet valve on the sprinkler body for movement exteriorly of the sprinkler body (1) from an open position disposed out of the path of the stream progressively through the stream and generally inwardly onto the outwardly facing annular valve seat into a closed position with respect to the outlet so as to contain water under pressure within the sprinkler body and prevent flow thereof outwardly of the outlet beyond the annular valve seat and (2) from the closed position generally outwardly from the outwardly facing valve seat and progressively out of the stream into the open position, and an actuator for effecting movement of the poppet valve from the open position into the closed position while the sprinkler body is communicated with the source of water under pressure and the water under pressure is flowing through the sprinkler body outwardly of the outlet and from the closed position into the open position.

9 Claims, 6 Drawing Figures

COMBINED ROTARY IMPULSE SPRINKLER HEAD AND SHUT-OFF VALVE

This invention relates to agricultural irrigation and more particularly to improvements in a combined high capacity sprinkler head and shut-off valve used in agricultural irrigation.

There are presently available many different systems for applying irrigation water to agricultural fields with the use of sprinkler heads. Examples include permanent set systems, solid set systems, hand move systems, side roll wheel move systems, towline systems, traveling sprinkler systems, moving lateral systems and center pivot systems. In many of these systems all of the sprinkler heads embodied in the system are operated simultaneously so that shut-off is accomplished systemically with a single shut-off valve. In others as, for example, a permanent set system or a solid set system, the total capacity of all of the sprinkler heads embodied in the system greatly exceeds the water input capacity provided so that it becomes necessary in the normal operation of the system to periodically shut off the flow of water through a number of the sprinkler heads provided while the input water capacity is utilized with the remaining number of sprinkler heads. Under these circumstances it is not possible to provide a single shut-off valve for the entire system. Instead, a plurality of shut-off valves must be provided and in some systems the number of shut-off valves necessary is equal to the number of sprinkler heads provided.

Where the nature of the system is such that a plurality of shut-off valves must be provided, it is usual that the shut-off valves are mounted in the feed lines to the sprinkler heads and are provided with some power operated devices as, for example, solenoids or fluid pressure actuators, by means of which the valves can be moved between a shut-off position and an operative position. It is desirable that the power operated device be capable of remote control so that the system can be automated.

All of the power operated remotely controlled shut-off valve mechanisms presently available suffer from several disadvantages. First and foremost is the fact that since all of the input water of the system must flow through the shut-off valves when they are in their operative position, the valves constitute a significant source of friction or pressure loss to the system. Where the system is utilized to distribute fertilizer and other additives to the field as is often the case, the operating shut-off valves constitute a source of debris hang-up which can ultimately result in system malfunction. Moreover, where the system utilizes high capacity sprinkler heads it is often the practice to combine the shut-off valve with the head in which case the turbulence caused by the shut-off valve operating at the inlet of the sprinkler head can have a detrimental effect on the efficiency of the sprinkler head.

It is an object of the present invention to provide a combined sprinkler head and shut-off valve which will completely eliminate the three major disadvantages discussed above, enabling each sprinkler head of an agricultural irrigation system to be effectively shut off or operated without energy loss, without debris hang-up and without turbulence. In accordance with the principles of the present invention, this objective is obtained by providing a shut-off valve seat on the nozzle outlet of the sprinkler head disposed in surrounding relation with the discharge orifice of the nozzle and by mounting a poppet valve on the sprinkler body for movement exteriorly of the sprinkler body (1) from an open position disposed out of the path of the stream progressively through the stream and generally inwardly onto the outwardly facing annular valve seat into a closed position with respect to the outlet so as to contain water under pressure within the sprinkler body and prevent flow thereof outwardly of the outlet upon the annular valve seat, and (2) from the closed position generally outwardly from the outwardly facing valve seat and progressively out of the stream into the open position. In this way, when the poppet valve is in its open position permitting the sprinkler head to operate, there are no surfaces provided by the structure for performing the shut-off valve function which contact the water during the normal operation of the sprinkler head. Hence, there is no friction or energy loss. Moreover, there are no surfaces on which debris hang-up can occur and there are no surfaces which can provide turbulence to the stream.

It is recognized that the patented prior art contains proposals for closing off the discharge opening of a sprinkler head of the step-by-step rotary impact type. Such an arrangement is disclosed in U.S. Pat. No. 3,204,874, however, the purpose of closing off the discharge opening is so that when the sprinkler head is not in operation, access to the interior of the nozzle will be denied "mud daubers" and other wasps and bees who find the nozzle discharge opening a convenient place to build their nests. As stated in U.S. Pat. No. 3,204,874, where the sprinkler is not used for several days the nozzle can actually become completely blocked by these nests. In citrus groves the spray nozzle head is carried atop a fixed riser and may be located as much as 20–30 feet in the air. Thus, blockage of the nozzle presents a difficult maintenance problem due to the difficulty of providing access to the actual nozzle opening. Where hundreds and even thousands of sprinklers are used in a single system, the maintenance problem is very serious.

Step-by-step rotary impact sprinkler heads of the type contemplated in U.S. Pat. No. 3,204,874, where hundreds and even thousands may be embodied in one system, are of relatively low capacity compared with the high capacity type sprinkler heads contemplated in the present invention. Examples of high capacity sprinkler heads of the type herein contemplated are contained in the following U.S. Pat. Nos. 1,710,107; 1,811,171; 2,649,268; 3,559,887; 3,580,507; 3,592,388; 3,744,720; 3,986,671; 4,109,866; 4,161,286; 4,153,202; 4,193,548. These high capacity sprinkler heads are sometimes referred to as rotary impulse sprinkler heads in order to distinguish them from the lower capacity rotary impact sprinkler heads. This language difference is keyed to the different principles by which the two types of sprinkler heads are driven. Both types include oscillating drive arms provided with drive spoons which contain reactant surfaces for engaging the stream. An impact type drive arm is mounted for oscillation about a vertical axis and the drive spoon is moved out of the stream in a stroke which does not impart any movement to the sprinkler body. On the return stroke the drive arm impacts the sprinkler body and effects an incremental movement. In contrast, an impulse drive arm is mounted for pivotal movement about a horizontal axis so that when the reactant surfaces of the drive spoon are contacted by the stream a tangential reactant force is imposed upon the sprinkler body which serves to effect the incremental movement thereof.

Another difference between high capacity impulse sprinkler heads and the lower capacity impact heads resides in the manner in which part-circle operation is achieved. The relatively low capacity sprinkler heads provide a reversing mechanism for modifying the oscillating cycle of the drive spoon so that the reverse movement of the sprinkler head is accomplished by a series of rapid impact induced incremental movements, whereas in high capacity sprinkler heads a separate return spoon is provided which serves to achieve the return movement in a single continuous pivotal action.

Normally, the size of the nozzle opening in a high capacity sprinkler head is such that a mud dauber blockage problem with respect to the same is of little or no consequence. For example, U.S. Pat. No. 3,204,847 relating to the lower capacity impact sprinkler heads recites nozzle sizes within the range of ⅛" to 5/16" in diameter (column 1, line 19), whereas U.S. Pat. No. 3,559,887, which relates to high capacity impulse sprinkler heads recites nozzle orifice sizes in the range of 1¼" to 2" (column 6, lines 61–62). For the purpose of preventing mud dauber access, the closure member described in U.S. Pat. No. 3,204,874 is in the form of a bent metal guard plate mounted on the sprinkler head so as to be normally biased into a closed position with respect to the nozzle outlet orifice. A fluid actuator is provided on the sprinkler body in communication with the interior water passage therein so that when the water is turned on the actuator is energized to move the metal guard plate from its closed position into an open position out of the path of the stream. The arrangement is such that when the water is turned off the actuator is deenergized and the guard plate moves from its open position into its closed position under its own spring bias. Thus, the arrangement is one in which the movement of the guard plate from its open operative position to its closed position always takes place when the water has been shut off.

It has also been proposed in the patented literature to incorporate the mud dauber protection provided in U.S. Pat. No. 3,204,874 in a sprinkler head of the type having a sequencing valve associated therewith. In this arrangement disclosed in U.S. Pat. No. 3,402,890 the bent guard plate is replaced by a sliding valve plate having an opening in the central portion thereof which is normally spring biased into a closed position but which is capable of movement into an intermediate closed position between the normally biased closed position and the open position wherein the opening is aligned with the outlet nozzle orifice. A sequencing mechanism is interposed between the fluid actuator communicating with the interior water passages of the sprinkler head and the valve plate so that each time the water to the sprinkler head is turned off the valve plate will be moved under its own spring bias into its closed position, whereas each time the water to the sprinkler head is turned on the valve plate will be either moved into its intermediate closed position or its open position, depending upon the setting of the sequencing mechanism. In an exemplary embodiment, in nine successive water turnons, only one will result in the movement of the valve plate into its open position. The remaining eight result in the movement of the valve plate into its intermediate closed position. In any event, movement of the valve plate into its normally closed position is always accomplished with the water turned off.

Exterior poppet-type valves for use with fire hose nozzles which operate on a similar principle for the purpose of preventing the ingress of foreign matter into the nozzle are also known in the expired prior art as exemplified by U.S. Pat. Nos. 1,781,028 and 2,621,975.

While the provision of exterior shut-off valves of this type in agricultural irrigation systems obviates a measure of the disadvantages which the present invention eliminates, it will be understood that where the sequencing of the valve is in response to the shut-off of the water flowing through the sprinkler head body, the system must be provided either with in-line control valves upstream of the sprinkler head or means for deactivating and activating the pump prime mover. In the event that upstream control valves are used, these valves themselves provides the disadvantages previously noted relating to energy loss and material hangup. In the event that activating and deactivating of the prime movers is utilized there exists the possibility of malfunction due to pressure surging and the like.

In accordance with the principles of the present invention, a power actuating mechanism for moving the shut-off valve from its open position into its closed position is provided which is separate from the flow of water under pressure through the sprinkler head so that such movement can take place while the water is issuing from the discharge orifice. With this arrangement, it becomes possible to control the water within the system itself solely by the shut-off valves provided with each sprinkler head so as to fully secure all of the advantages noted above.

In conjunction with the provision of a combined sprinkler head and shut-off valve having a valve actuating mechanism capable of moving the shut-off valve from its open position into the closed position while the water under pressure is issuing from the outlet nozzle, it is important that the valve structure which engages the stream issuing from the outlet orifice be formed with surface means operable during the progressive contact of the valve with the stream which create reaction forces generally free from resultant force components acting tangentially to the vertical axis of rotation of the sprinkler head. It will be understood that the elimination of the establishment of such tangential resultant forces during the closing movement of the valve constitutes an important safety feature. An arrangement which permits the creation of such tangential resultant forces would tend to impart a rapid rotational movement to the sprinkler head during shut-off, which rapid rotation could cause injury to personnel which may be present and/or injury to the sprinkler head itself.

Accordingly, it is an object of the present invention to provide a combined sprinkler head and shut-off valve which is simple in construction, effective in operation, and economical to manufacture and maintain.

These and other objects of the present invention will become more apparent during the course of the following detailed description and appended claims.

The invention can best be understood with reference to the accompanying drawings wherein:

Figure 1:
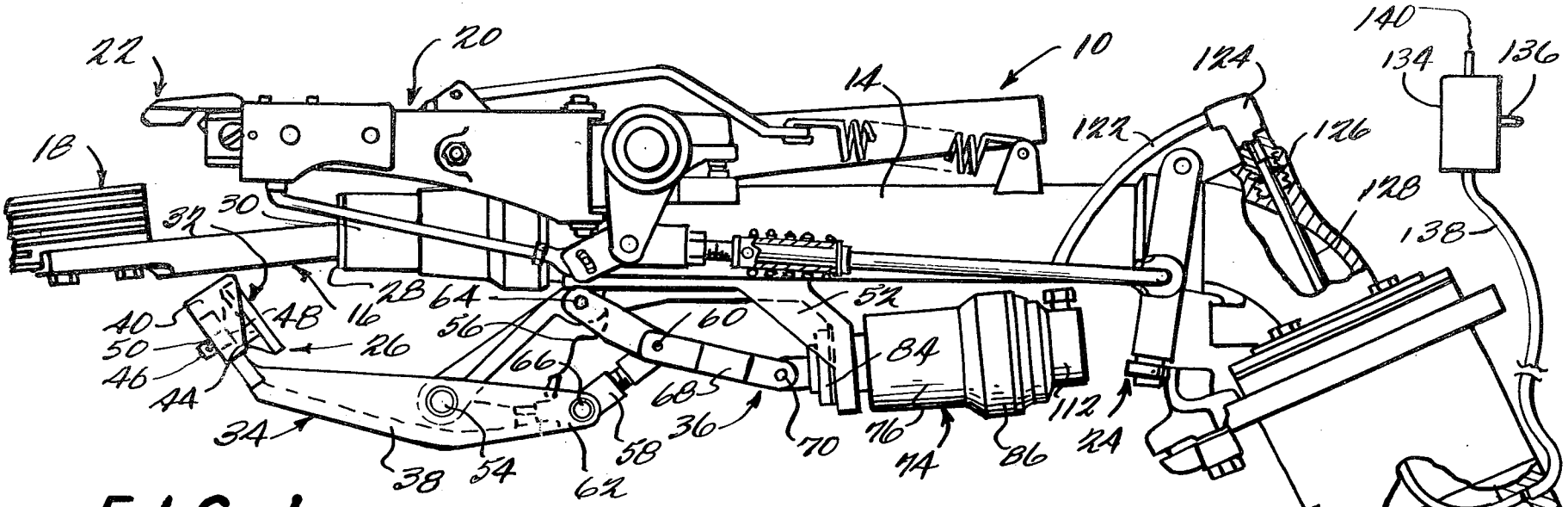
FIG. 1 is a side elevational view of a combined rotary impulse sprinkler head and shut-off valve embodying the principles of the present invention, showing the shut-off valve in its open position.

Referring now more particularly to the drawings, there is shown in FIG. 1 thereof a combined sprinkler head and shut-off valve which includes a sprinkler head, generally indicated at 10, adapted to be mounted on the upper end of a riser pipe, the lower end of which is communicated through suitable conduit to a source of water under pressure. Where the head 10 is used to sprinkler irrigate, the riser may be stationarily mounted in the field or may be carried by a traveling vehicle. For example, the sprinkler head 10 of the present invention would find particular utility in a traveling sprinkler irrigation device of the type disclosed in commonly assigned U.S. Pat. No. 3,507,336 dated Apr. 21, 1970.

The sprinkler head 10 of the present invention includes, in general, a swivel and spring brake assembly, generally indicated at 12, which is adapted to be connected at its lower end with the riser. A sprinkler body, generally indicated at 14, is connected with the upper end of the swivel and spring brake assembly in hydraulic communication with the riser pipe for directing the flow of water upwardly and outwardly, the swivel and spring brake assembly 12 mounting the sprinkler body for controlled rotational movement about a generally vertical axis. The sprinkler body 14 directs the water under pressure communicated therewith in a stream flowing therefrom in generally symmetrical relation to a plane passing through the axis of rotation.

An impulse arm assembly, generally indicated at 16, is pivotally mounted on the sprinkler body for oscillatory movement about an axis extending transverse to the aforesaid plane. The impulse arm assembly 16 includes a reactant means, generally indicated at 18, on the outer end thereof and is normally biased into a limited position wherein the reactant means 18 is disposed within the path of a stream issuing from the sprinkler body. The reactant means 18 is operable in response to the energy of a stream issuing from the sprinkler body to effect movement of the arm through repeated oscillatory cycles, each of which includes an impulse stroke wherein the reactant means leaves the stream and moves away from the latter in one direction and a return stroke wherein the reactant means moves in the opposite direction toward the stream and enters the latter. The reactant means 18 is also operable during the portion of each oscillatory cycle when it is disposed within the stream to impart an incremental rotational movement to the sprinkler head which is controlled by the swivel and spring brake assembly 12.

The sprinkler head 10 also includes a reversing arm assembly, generally indicated at 20, which is pivotally mounted on the sprinkler body for oscillatory movement about an axis extending transverse to the aforesaid plane and which, preferably, is concentric with the pivotal axis of the impulse arm assembly 16. The reversing arm assembly 20 includes a reversing reactant means 22 on the outer end thereof and is normally biased into a limited position wherein the reactant means 22 is disposed out of the path of a stream issuing from the sprinkler body. The reversing arm assembly 20 is adapted to be used when it is desired to sprinkler irrigate an area less than a full circle, as for example, a segmental portion of a circle proceeding from one end thereof to the opposite end thereof. The reversing arm assembly 20 is operable to rotate the sprinkler head from the opposite end back to the one end and in order to accomplish this operation, there is provided a reversing arm actuating mechanism, generally indicated at 24, which is operable in response to the sprinkler body reaching the opposite end of its rotation to effect a pivotal movement of the reversing arm assembly from its normally biased position into a position wherein the reversing reactant means 22 is engaged by the stream issuing from the sprinkler body and maintained therein by the stream against its normal bias. The reversing arm actuating mechanism 24 is operable, in response to the reversing rotational movement of the sprinkler body back to its one end, to effect a pivotal movement of the reversing arm assembly 20 back into its normally biased position wherein the reactant element 22 is disposed out of the path of the stream.

The swivel and spring brake assembly 12 may assume any known construction and the details thereof form no part of the present invention. An exemplary embodiment is shown in the aforesaid U.S. Pat. Nos. 3,559,887 and 3,623,666. Further examples are illustrated in U.S. Pat. Nos. 3,744,720 and 4,193,548. Accordingly, the disclosure of each of these patents is incorporated by reference into the specification.

In a similar manner, the impulse arm assembly 16 and reactant means 18 may be of any known construction, the details of which form no part of the present invention. Here again, a preferred embodiment is disclosed in the aforesaid U.S. Pat. No. 3,559,887, whereas U.S. Pat. No. 3,623,666 suggests a further alternative embodiment which may be utilized.

While the present invention has applicability to sprinkler heads which are of the full circle type and are not provided with reversing mechanisms rendering them capable of part circle operation, the invention is exemplified with a sprinkler head 10 having a reversing arm assembly 20 embodying all of the improvements disclosed in detail in commonly assigned U.S. Pat. No. 4,153,202. If desired, the improvements disclosed in commonly assigned U.S. Pat. No. 4,094,467 may be embodied in the reversing arm actuating mechanism 24. Accordingly the disclosures of the latter two patents are also incorporated by reference in the present specification.

Figure 3:
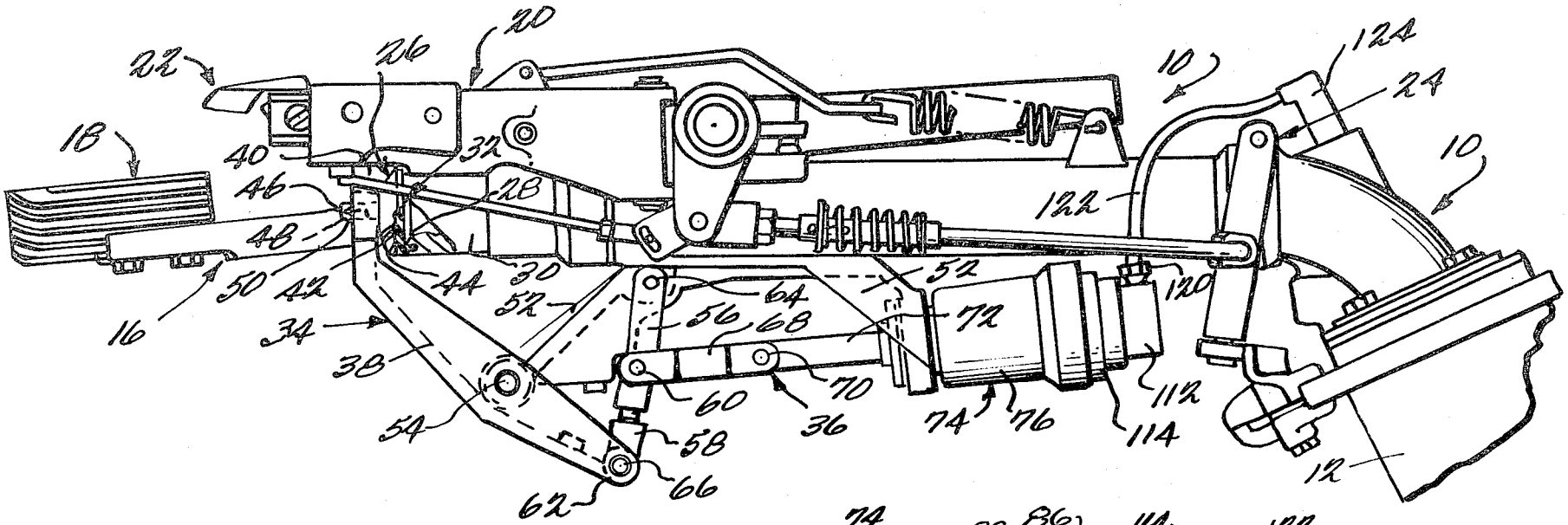
FIG. 3 is a view similar to FIG. 1 showing the shut-off valve in its closed position.

The combined sprinkler head and shut-off valve of the present invention importantly embodies with the sprinkler head 10 an exteriorly mounted shut-off valve assembly, generally indicated at 26. As shown, the shut-off valve assembly 26 includes an outwardly facing annular valve seat 28 formed in the outer end surface of an outlet nozzle 30 of the sprinkler body 14 from which the stream flows. As best shown in FIG. 3 the annular valve seat is provided by the outwardly facing surface of an annular ring seated within the end of the nozzle 30 so that the seat surrounds the outlet through which the stream flows.

The shut-off valve assembly 26 also includes a poppet valve member 32 which cooperates with the valve seat, a poppet valve mounting mechanism, generally indicated at 34, which serves to mount the poppet valve member 32 for movement between open and closed positions with respect to the valve seat 30 and a poppet valve moving mechanism, generally indicated at 36, for effecting movement of the poppet valve member between the aforesaid open and closed positions.

The poppet valve mounting mechanism 34 comprises a mounting arm 38 which includes a main portion of generally channel shaped cross-sectional configuration terminating in an angular valve retaining end 40. As best shown in FIG. 3, the poppet valve member 32 includes a resilient disc valve element 42 mounted within a holder 44 having an end face which surrounds and is flush with the exterior flat surface of the disc valve element 42. Holder 44 includes a central stem 46 extending from the opposite surface thereof which is engaged within a suitable opening 48 in the mounting arm end 40. Stem 46 extends through the aperture 48 and is retained in position by a retaining pin 50.

The mounting mechanism 34 also includes a bracket 52 which is suitably fixed to the underside of the barrel of the sprinkler body 14, as by welding or the like. A forward portion of the bracket extends forwardly and downwardly and is apertured to receive a horizontally extending pivot pin 54 the ends of which extend through pivot openings formed in the legs of the channel shaped central portion of the mounting arm 38. The pivot pin 54 carried by the bracket 52 thus serves to secure the mounting arm 38 to the sprinkler body for pivotal movement about a horizontal axis which is spaced in a direction upstream and downwardly from the outlet nozzle 30 of the sprinkler head 10.

FIG. 3 illustrates the closed position of the disc valve element 42 with respect to the annular valve seat 28. It will be noted that by virtue of the position of the pivotal axis 54 poppet valve member 32 in moving from the closed position shown in FIG. 3 to the open position shown in FIG. 1 will move such that the only surface presented for contact by the stream issuing from the outlet nozzle 30 during the movement between the open and closed positions is the flat surface of the valve element 42 which engages the valve seat and the co-planar peripheral edge of the valve element retainer. Moreover, since this planar flat surface moves with a pivotal movement about a horizontal axis, any reactant forces created by virtue of the contact of the stream therewith is generally free from resultant force components acting tangentially to the vertical rotary axis of the sprinkler head itself. The absence of any such substantial tangential force components is essential to prevent unwanted pivotal movements of the sprinkler head which could occur in view of the fact that the poppet valve member 32 is moved between its open and closed positions in normal operation while the stream is issuing from the outlet nozzle 30.

The poppet valve moving mechanism 36 includes a pair of links 56 and 58 which are pivotally interconnected, as by pivot pin 60. The pivotally interconnected links 56 and 58 constitute a toggle linkage which is mounted between the bracket 52 and a bifurcated end 62 of the mounting arm 38 opposite from the end 40 thereof. As shown, the free end of the link 56 is pivotally mounted on the bracket, as by a pivot pin 64, while the free end of the link 58 is pivoted to the bifurcated mounting arm end 62, as by a pivot pin 66. The central pivot pin 60 which interconnects the two links is also pivotally connected with the bifurcated end of a connecting link 68, the opposite end of which is pivotally connected, as by a pivot pin 70, to the outer end of a plunger or piston rod 72 forming a part of a fluid pressure actuator, generally indicated at 74.

Figure 2:
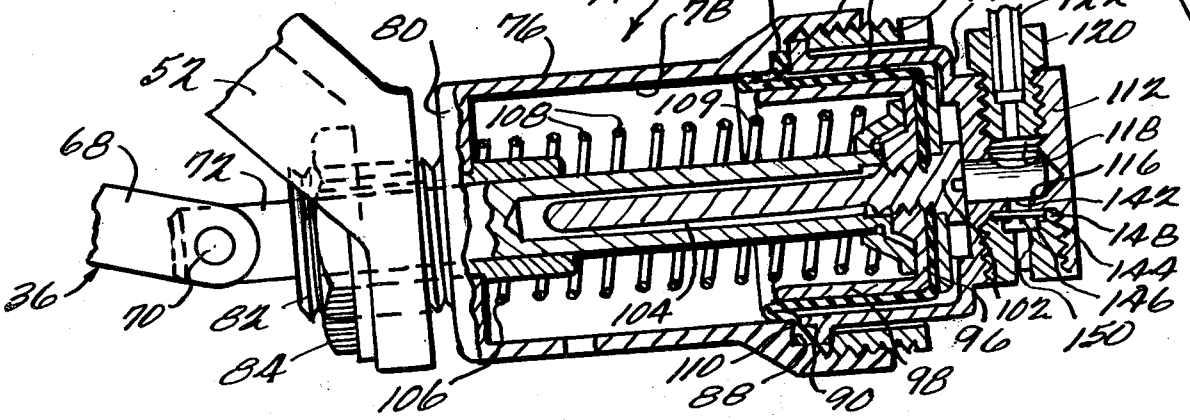
FIG. 2 is a vertical sectional view of the valve actuating mechanism shown in FIG. 1.
Figure 4:
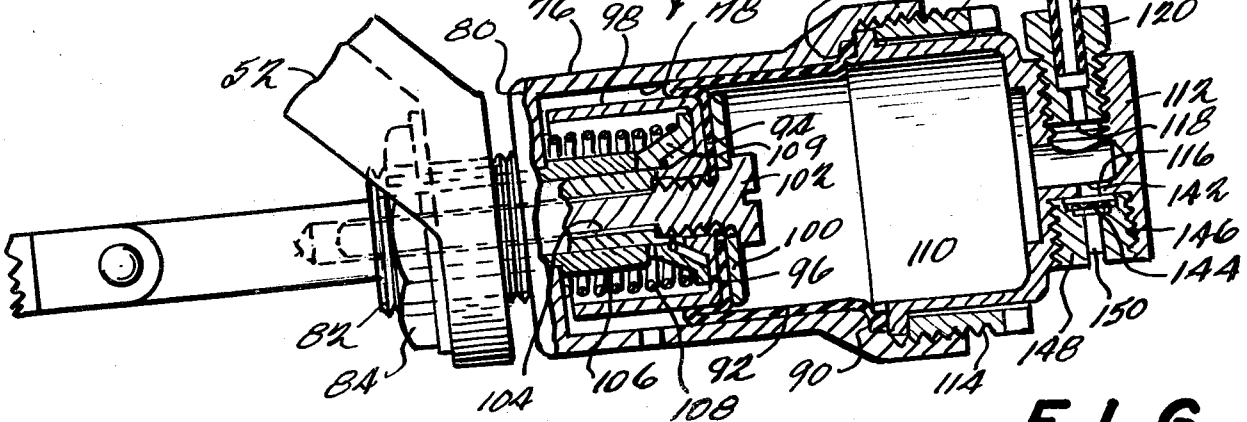
FIG. 4 is a view similar to FIG. 2 illustrating the position of the valve actuating mechanism when the shut-off valve is in its closed position.
Figure 5:
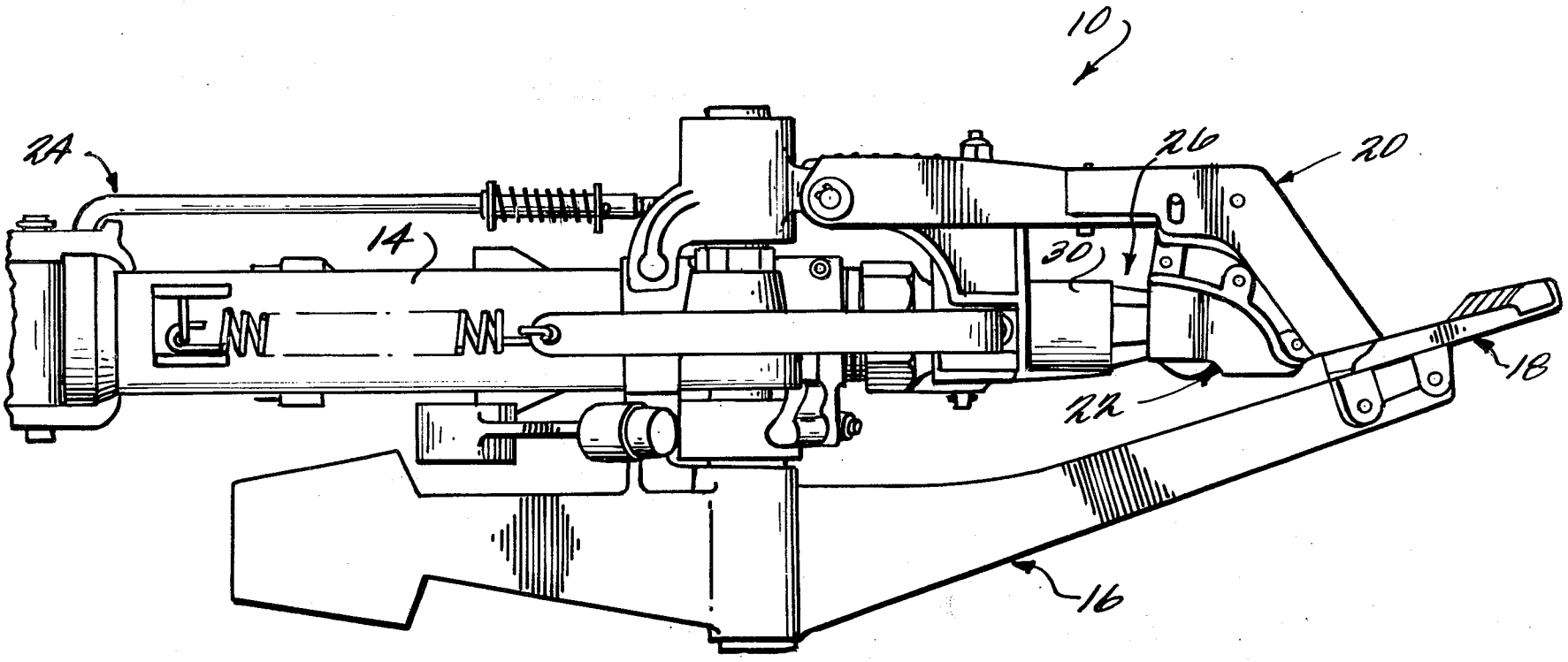
FIG. 5 is a top plan view of the combined sprinkler head and shut-off valve as shown in FIG. 1.
Figure 6:
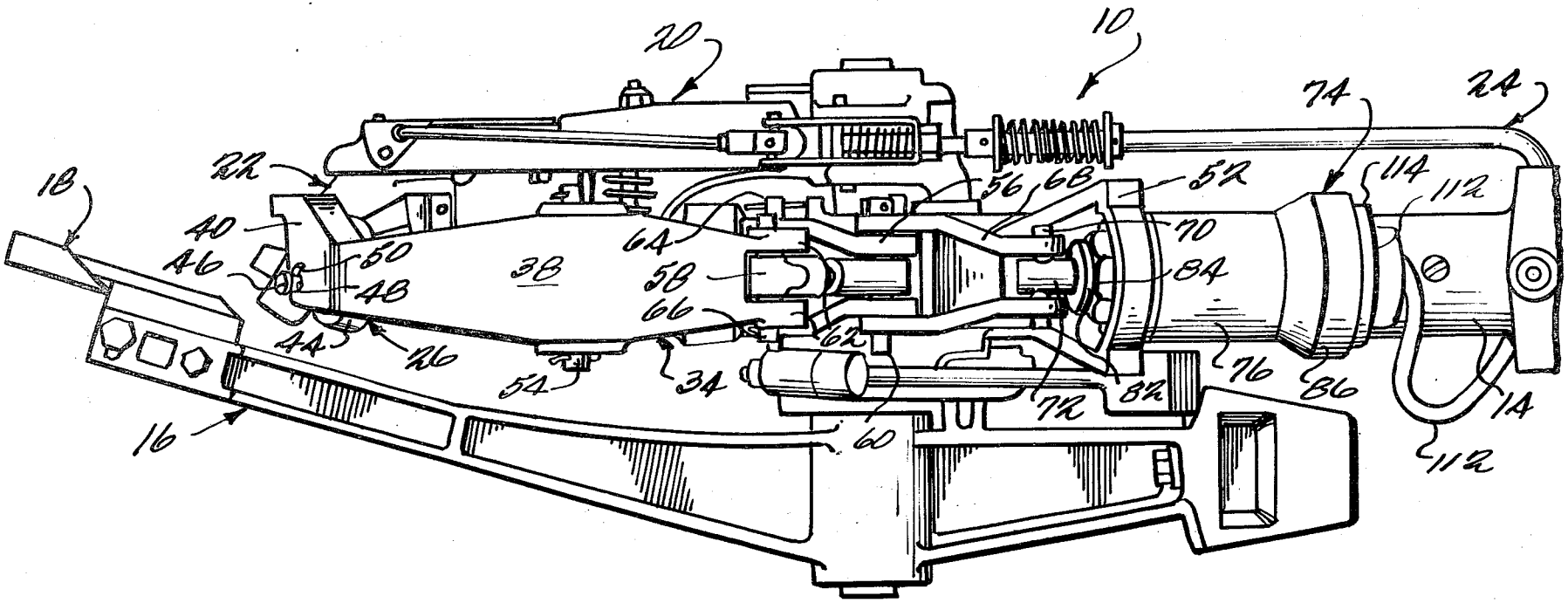
FIG. 6 is a bottom view of the combined sprinkler head and shut-off valve shown in FIG. 1.

As best shown in FIGS. 2 and 4, actuator 74 includes a tubular housing member 76 including a peripheral wall having an interior peripheral cylinder surface 78 and an annular end wall portion 80 extending radially inwardly from one end thereof which, in turn, has a tubular mounting wall portion 82 extending axially from the inner periphery thereof. The mounting wall portion 82 is exteriorly threadedly engaged within an interiorly threaded opening formed in the adjacent portion of the bracket 52. A lock nut 84 is threaded on the wall portion 82 outwardly of the bracket 52 to lock the housing member 76 in engagement therewith.

The peripheral wall of the tubular housing member 76 at the end thereof opposite from the end wall portion 82 has an interiorly threaded enlarged socket portion 86 formed thereon. At the juncture between the socket portion 86 and the interior surface 76 there is provided an annular groove 88 within which is seated an annular bead 90 formed on one end of a folded rolling seal or sleeve 92. An opposite end of the folded rolling seal has formed integrally thereon a transverse end wall 94. The outer surface of the end wall 94 engages an inner end surface of a piston member 96 providing an exterior peripheral cylindrical surface 98 of a size less than the cylindrical surface 78. The seal end wall 94 is sealingly fixed to the end wall of the piston member 96 as by a circular plate 100 and an elongated securing bolt 102 extending therethrough and through the end wall 94 into the piston. Seal 92 folds between the cylindrical surfaces 78 and 98 and includes inner and outer portions engaging the surfaces 78 and 98 respectively.

The bolt 102 includes an elongated free end portion which loosely guidingly engages within a hollow end portion 104 of the piston rod 72. Preferably, the piston rod is slidably mounted within the housing end portion as by an annular bearing sleeve 106. A coil spring 108 is mounted in surrounding relation with respect to the inner end of the bearing sleeve 106 and the associated end of the piston rod 72. One end of the coil spring seats against the housing end wall portion 80 and the opposite end thereof seats against an annular spring retainer 109 mounted on the end of the piston rod 72 as by a C-clip or the like. Spring 108 serves to bias the piston rod inwardly into engagement with the piston and hence to resiliently bias the piston member in a direction away from the end wall 80. It will be noted, however, that since the connection of the piston rod to the piston is a one-way connection, the piston rod can be moved in the opposite direction while the piston remains stationary. This latter movement provides an important protection for the folded rolling seal 92 under circumstances where the actuator 74 is in the position shown in FIG. 2 corresponding with the open position of the valve and an attempt is made to manually close the valve. Without the one-way connection which permits such movement without any displacement of the piston, the piston would tend to be displaced resulting in the seal becoming folded over and jammed against proper movement.

The folded rolling seal bead 90 is retained within the groove 88 by a radially outwardly extending end flange 110 of an end housing member 112. End housing member 112 is retained in position by an exterior sleeve 114 threadedly engaged within the internally threaded socket portion 86 of the housing member 76 in a position to engage the end flange 110.

Formed in the end housing member 112 is a central fluid pressure passage 116 which communicates laterally with an inlet passage 118. A fitting 120 serves to communicate one end of a flexible conduit 122 with the inlet 118. The opposite end of the conduit 122 is connected with a fitting 124 engaged within an opening formed in the upper central portion of the sprinkler body 10 in axially aligned relation with respect to the vertical axis of rotation of the sprinkler body. The fitting 124 has an O-ring 126 mounted therein which is adapted to engage the exterior periphery of one end of a rigid tube 128. The tube 128 is essentially L-shaped in configuration and has a vertical leg, which extends through the sprinkler body into the main water passage therein and a horizontal leg which is sealingly engaged within an opening 130 extending radially through the wall of the stationarily mounted swivel and spring brake assembly 12. L-shaped tube 128 is thus stationarily mounted in fixed relation to the stationarily mounted structure 12. Since the vertically extending leg of the tube 128 is concentric with the vertical pivotal axis of the sprinkler body 10, the O-ring seal 126 of the fitting 124 will provide a rotary seal between the moving structure and stationary structure permitting fluid under pressure to be conveyed through inlet 118 and passage 116 into an expansion chamber 132 defined between the interior of the member 112 and the interior of the folded rolling seal 92.

It will be understood that the above arrangement provides for the conveyance of a fluid under pressure to a position on the sprinkler head which may move continuously in one direction about the vertical axis of movement. Such an arrangement is not essential where the sprinkler head is to be always used in part circle mode. Under these circumstances a fluid pressure supply line and control for the actuator could be positioned at the dry segment of the pattern. With the above-described arrangement which accommodates full circle operation, the operation of the actuator 74 can be placed under the control of a suitable three-way valve 134 which serves to control the communication of a source of fluid under pressure, as for example, water under pressure in a supply line 136 to the opening 130 through a conduit 138. In one position valve 134 communicates the conduit 138 with the supply of water under pressure from line 136 while in the other position conduit 138 is communicated to a drain line 140. Valve 134 may be pilot pressure actuated, solenoid actuated or otherwise arranged for remote operation. Valve 134 could be manually operable from a central location.

In order to provide a liquid drain to prevent damage due to water freezing, passage 116 is formed with a drain opening 142 in the lower portion thereof. The drain opening 142 has a resilient disc or diaphragm 144 communicated therewith which is formed with a series of drain holes 146 positioned at the periphery of the drain opening 142. A drain plug 148 serves to retain the resilient disc 144 peripherally in position adjacent the drain hole 142. The drain plug includes a drain passage 150 of a size less than the opening 142. When fluid under pressure is communicated with the passage 116 it will enter the opening 142 and create a pressure differential across the drain holes 146 in the resilient disc or diaphragm 144, causing the latter to move away from the opening 142 and into engagement with the wall defining the inlet side of the drain passage 150. By virtue of this engagement water no longer is allowed to pass through the annularly arranged drain holes 146. So long as the water within the passage 116 is at a pressure above atmospheric pressure, the diaphragm will remain in its extended closed position. When this pressure is relieved to atmospheric conditions, as by the operation of the valve 134, the pressure acting on both sides of the diaphragm is equalized, causing the same to move into the position shown in FIG. 2 wherein the water in communication with passage 116 is allowed to drain through the annularly arranged drain holes 146 and out drain passage 150.

In operation the spring 108 is strong enough to maintain the actuator 74 in a retracted position, as shown in FIG. 2. In this position, piston rod or plunger 72 is dropped to the right, as shown in FIG. 1, a maximum distance which, in turn, positions the link 68 to the right in a position to buckle the toggle linkage and cause the end 62 of the mounting arm connected thereby to be disposed upwardly so that the valve member 42 carried by the opposite end of the mounting arm is disposed downwardly in a position out of the path of movement of a stream issuing from the nozzle 30 of the sprinkler body 14. When it is desired to move the valve member 42 into a closed position, control valve 134 is moved into a position to communicate water pressure source line 136 with supply conduit 138. Water under pressure is then allowed to flow through the conduit 138 and into tube 128, through tube 128 into fitting 124 and from fitting 124 through conduit 122 to fitting 120. Fitting 120 directs fluid under pressure into inlet 118 which, in turn, communicates with passage 116. In this way fluid under pressure is communicated with the expandable chamber 132. The fluid under pressure acts on the piston member 96 tending to move the same to the left, as viewed in FIGS. 2 and 4, against the action of spring 108, causing piston rod 172 to move outwardly through the sleeve 106 so as to effect a movement of the connecting link 68 to the left, as viewed in FIGS. 1 and 3. This movement causes the links 56 and 58 of the toggle linkage to straighten, thus moving the end 62 of the mounting arm downwardly and the valve member 42 of the other end thereof arcuately upwardly. During this movement the surface of the valve member is engaged by the stream deflecting the same so that a reactant force is established thereon. However, since the surface engaged by the stream has no angular inclination with respect to the stream in a direction tangential to the vertical pivotal axis of the sprinkler head, the reactant force acting on the valve member does not have any substantial component acting in the tangential direction. Consequently as the valve member moves in engagement with the stream, the reaction of the stream on the valve does not cause any turning of the sprinkler body about its axis. Normally, the movement of the valve member from its open position as shown in FIG. 1, through the stream into its closed position as shown in FIG. 3, is effected fairly rapidly. It will be noted that in the closed position the links 56 and 58 of the toggle linkage are substantially in a center position, although they may move slightly over center if desired. The arrangement is such that when the control valve 134 is moved back into its opposite position so as to enable supply conduit 138 to be communicated with atmospheric pressure through drain line 140, the pressure acting on the closed valve member in conjunction with the force of return spring 108 cause the parts to move rapidly from the closed position shown in FIG. 3 to the open position shown in FIG. 1. Once this movement has taken place the operation of the drain diaphragm is such as to permit the flow of sufficient water from the chamber 132 as to prevent damage due to freezing.

It thus will be seen that the objects of this invention have been fully and effectively accomplished. It will be realized, however, that the foregoing preferred specific embodiment has been shown and described for the purpose of illustrating the functional and structural principles of this invention and is subject to change without departure from such principles. Therefore, this invention includes all modifications encompassed within the spirit and scope of the following claims.

What is claimed is:

1. A sprinkler head comprising:

a sprinkler body having an inlet and an outlet, means adapted to be communicated with a source of water under pressure for communicating the same with said inlet and for mounting said sprinkler body for movement about a generally vertically extending axis so that water under pressure communicated with said inlet will flow through said sprinkler body and outwardly from the outlet thereof in a stream flowing in a generally upward and outward direction, means operable in response to the aforesaid flow of water under pressure for effecting progressive movements of said sprinkler body about said axis, means defining an outwardly facing annular valve seat on said sprinkler body disposed in surrounding relation to said outlet, poppet valve means cooperable with said annular valve seat, means mounting said poppet valve means on said sprinkler body for movement exteriorly of said sprinkler body (1) from an open position disposed out of the path of said stream progressively through said stream and generally inwardly onto said outwardly facing annular valve seat into a closed position with respect to said outlet so as to contain water under pressure within said sprinkler body and prevent flow thereof outwardly of said outlet beyond said annular valve seat and (2) from said closed position generally outwardly from said outwardly facing valve seat and progressively out of said stream into said open position, means for effecting movement of said poppet valve means from said open position into said closed position while said sprinkler body is communicated with the source of water under pressure and the water under pressure is flowing through said sprinkler body outwardly of said outlet and from said closed position into said open position, surface means on said poppet valve means operable during the progressive movement of said poppet valve means through said stream for engaging said stream and maintaining reaction forces created thereby generally free from resultant force components acting tangentially to said axis.

2. A sprinkler head as defined in claim 1 wherein said mounting means includes a mounting arm carrying said poppet valve means on one end thereof and pivot means spaced below and in a direction upstream from said outlet mounting said arm for pivotal movement about a horizontally extending axis.

3. A sprinkler head as defined in claim 2 wherein said movement effecting means comprises an actuator, a toggle linkage interconnected between said sprinkler body and an opposite end of said mounting arm and a connecting link interconnecting said actuator with the center of said toggle linkage.

4. A sprinkler head as defined in claim 3 wherein said actuator includes a housing fixed to said sprinkler body, said housing having a cylindrical chamber therein, a piston mounted within said chamber for generally reciprocating movement therein, means providing a peripheral seal for said piston within said chamber, conduit means connected with said chamber for directing a supply of fluid under pressure into said chamber so as to move said piston through a stroke corresponding to a movement of said poppet valve from its open position to its closed position.

5. A sprinkler head as defined in claim 4 wherein said actuator includes spring means for moving said piston through an opposite stroke when the pressure of the fluid within said chamber is relieved.

6. A sprinkler head as defined in claim 4 or 5 wherein said conduit means includes a conduit section fixed with respect to said sprinkler body mounting means and having a portion extending concentric with the vertical axis of rotation of said sprinkler body, said sprinkler body being rotatably sealingly connected with said conduit portion.

7. A sprinkler head as defined in claim 4 or 5 wherein said sealing means comprises a folded rolling sleeve having an outer portion engaging a cylindrical interior peripheral surface of said chamber and an inner portion engaging a cylindrical exterior peripheral surface of said piston spaced inwardly of the cylindrical interior peripheral surface of said chamber.

8. A sprinkler head as defined in claim 7 wherein said actuator includes a piston rod extending through said housing and connected exteriorly thereof with said connecting link, the interior end of said piston rod having a spring retainer thereon, said spring means comprising a coil spring surrounding the portion of said piston rod extending into said housing having one end engaging said spring retainer and the other end engaging said housing.

9. A sprinkler head as defined in claim 8 wherein the end portion of said piston rod extending within said housing is hollow and said piston includes an elongated guide element extending within the hollow end portion of said piston rod.

* * * * *